US006819206B2

(12) United States Patent
Emura et al.

(10) Patent No.: US 6,819,206 B2
(45) Date of Patent: Nov. 16, 2004

(54) CIRCUIT BREAKER

(75) Inventors: Takeshi Emura, Saitama (JP); Koji Asakawa, Saitama (JP); Katsunori Kuboyama, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/413,153

(22) Filed: Apr. 15, 2003

(65) Prior Publication Data

US 2004/0008098 A1 Jan. 15, 2004

(30) Foreign Application Priority Data

Apr. 19, 2002 (JP) ..... 2002-116939

(51) Int. Cl.[7] ..... H01H 73/12
(52) U.S. Cl. ..... 335/17; 335/132
(58) Field of Search ..... 335/17, 165–176, 335/132, 202; 200/293–308

(56) References Cited

U.S. PATENT DOCUMENTS 4,467,300 A * 8/1984 Harbauer ..... 335/131

FOREIGN PATENT DOCUMENTS

JP 6-68772 3/1994

* cited by examiner

*Primary Examiner*—Lincoln Donovan
(74) *Attorney, Agent, or Firm*—Manabu Kanesake

(57) ABSTRACT

A circuit breaker includes a switching mechanism, a manual operating handle connected to the switching mechanism, and an instantaneous tripping device for detecting a short circuit current and opening contacts of a main circuit. The instantaneous tripping device and a latch receiver of the switching mechanism are connected with each other via a trip member capable of sliding up and down. Further, the circuit breaker includes a trip indicating member moving along with the trip member, and a trip indicating window formed in a breaker housing and facing the trip indicating member. The trip indicating member moves to an indicating position to visually indicate a tripping state of the circuit breaker through the trip indicating window when the circuit breaker member instantaneously trips.

4 Claims, 6 Drawing Sheets

CIRCUIT BREAKER

BACKGROUND OF THE INVENTION AND RELATED ART STATEMENT

The present invention relates to a circuit breaker such as an auto-breaker, and more particularly to a trip indicating means thereof.

A circuit breaker has an over current tripping device for protecting a circuit and a device from an over current through tripping a switching mechanism to open a contact when an over current caused by overloading or short circuit in a main circuit is detected. The over-current tripping device has a time delay tripping device (bimetal type) that trips the switching mechanism with a delay corresponding to a magnitude of an overload current, and an instantaneous tripping device (electromagnetic type) that trips the switching mechanism instantaneously in response to a large current such as a short circuit current.

As an option, an alarm switch may be attached to the circuit breaker for indicating that the switching mechanism trips instantaneously when the short circuit current flows. When the circuit breaker trips in response to the short circuit current, the alarm switch attached to the circuit breaker sends a signal to the outside indicating the tripping.

With reference to FIGS. 6(*a*), 6(*b*), 7 and 8, a construction, and operation of the circuit breaker and the alarm switch attached to a main body of the circuit breaker will be explained. In FIGS. 6(*a*) and 6(*b*), a reference numeral 1 denotes a circuit breaker; a reference numeral 2 denotes a housing of the main body of the circuit breaker 1; a reference numeral 3 denotes a manual operating handle attached to a housing cover of the housing 2; a reference numeral 4 denotes an alarm switch attached to a side of the circuit breaker 1; and a reference numeral 5 denotes a trip indicating rod incorporated in the alarm switch 4. The trip indicating rod 5 is normally disposed inside a housing of the alarm switch 4. When the circuit breaker 1 trips instantaneously in response to the short circuit current, the trip indicating rod 5 is protruded from an upper side of the housing of the alarm switch 4 to indicate that the circuit breaker 1 instantaneously trips.

FIG. 7 is an assembly showing structures of a switching mechanism and an over-current tripping device incorporated in the circuit breaker 1. In FIG. 7, a reference numeral 6 denotes a switching mechanism for contacts: a reference numeral 6*a* denotes a swing type latch receiver incorporated in the switching mechanism 6; a reference numeral 6*b* denotes a transmission gear connected to the operating handle 3; a reference numeral 7 denotes a bimetal type time delay tripping device; a reference numeral 8 denotes an electromagnetic instantaneous tripping device; a reference numeral 8*a* denotes an electromagnetic coil; a reference numeral 8*b* denotes a plunger; a reference numeral 8*c* denotes a trip actuator attached to the plunger 8*b*; and a reference numeral 9 denotes a trip member for connecting the trip actuator 8*c* of the instantaneous tripping device 8 to the latch receiver 6*a* of the switching mechanism 6. The trip member 9 slides up and down to drive the latch receiver 6*a* to a release position in response to the operation of the instantaneous tripping device 8. The bimetal type time delay tripping device 7 is constructed such that an operating end of a bimetal thereof is connected to the latch receiver 6*a* via a temperature compensating bimetal, which is also used as an actuator lever, without going through the trip member 9.

FIG. 8 is a view showing a structure of the trip member 9 and a connection structure between the trip member 9 and the alarm switch 4. The trip member 9 formed of a resin plate is guided and supported to slide up and down in the breaker housing 2, and is urged upward by a return spring 10 inserted between the trip member 9 and a bottom of the breaker housing 2. The trip actuator 8*c* of the instantaneous tripping device 8 faces a shoulder part of the trip member 9. An end of the latch receiver 6*a* is inserted into a window hole with a cam surface formed on a surface of the trip member 9. The alarm switch 4 is comprised of the trip indicating rod 5 and an actuator lever 4*a* connected to an alarm contact point (not shown). An end of the actuator lever 4*a* is protruded into the housing 2 of the circuit breaker 1 and inserted into a concaved groove formed in a side of the trip member 9.

With the above arrangement, when a large current such as the short circuit current flows through a main circuit of the circuit breaker 1, the instantaneous tripping device 8 in FIG. 7 is operated to cause the trip actuator 8*c* thereof to push down the trip member 9 against the force of the return spring 10. Then, the latch receiver 6*a* tilts leftward to unlock a latch of the switching mechanism 6 (refer to FIG. 7) to cause the circuit breaker 1 to trip instantaneously. When the trip member 9 moves downward during the tripping, the actuator lever 4*a* of the alarm switch 4 turns counterclockwise. In response to the movement of the actuator lever 4*a*, the alarm contact point is turned on to transmit a trip signal to the outside, and the trip indicating rod 5 is pressed by a spring (not shown) to protrude from the housing 2 to indicate that the circuit breaker 1 instantaneously trips. The structure and operation of the switching mechanism 6 have been disclosed in detail in Japanese Patent Publication (KOKAI) No. 2001-23499 filed by the applicant of the present invention.

Further, the operating handle 3 of the circuit breaker 1 shown in FIGS. 6(*a*) and 6(*b*) is turned to a TRIP position located between an ON position and an OFF position in response to the tripping of the circuit breaker 1. Thus, it is possible to visually confirm that the circuit breaker 1 is tripped according to the position of the operating handle 3. In this case, it is difficult to determine whether the circuit breaker is tripped due to the overload current or the short circuit current.

As described above, the main body of the conventional circuit breaker can not indicate that the circuit breaker trips instantaneously. It is therefore necessary to provide the alarm switch in the main body of the circuit breaker as an attachment (option) so as to indicate whether the circuit breaker trips instantaneously. Therefore, even if a user does not need a function of transmitting an electric signal indicating that the circuit breaker trips instantaneously, and just needs to visually confirm that the circuit breaker trips instantaneously, the user has to obtain a space for installing the alarm switch.

It is therefore an object of the present invention to provide a circuit breaker that makes it possible to visually confirm that, the circuit breaker instantaneously trips due to a short circuit current only by adding a simple part to a tripping mechanism of the circuit breaker, thereby improving safety by holding the tripping mechanism at a trip position until the breaker is reset.

Further objects and advantages of the invention will be apparent from the following description of the invention.

SUMMARY OF THE INVENTION

To attain the above object, according to the present invention, a circuit breaker includes a switching mechanism for switching contacts, a manual operating handle connected to the switching mechanism, and an instantaneous tripping device for detecting a short circuit current and opening the contacts of a main circuit. In the circuit breaker, the instantaneous tripping device and a latch receiver of the switching mechanism are connected with each other via a trip member capable of sliding up and down. The trip member slides in response to a movement of the instantaneous tripping device, and drives the latch receiver to a release position to trip the switching mechanism. Further, the circuit breaker includes a trip indicating member attached to the trip member, and a trip indicating window formed in a breaker housing and facing the trip indicating member. The trip indicating member moves to an indicating position to visually indicate a tripping state of the circuit breaker through the trip indicating window when the circuit breaker instantaneously trips.

The trip indicating member is formed of a strip or band piece having one end connected to the trip member and a leading end provided with an engagement protrusion for identifying the tripping state. The leading end of the strip piece is situated at a backside of the trip indicating window formed in the breaker housing. When the circuit breaker trips instantaneously, the engagement protrusion is inserted into the trip indicating window to indicate that the circuit breaker instantaneously trips.

In addition to the configuration described above, the circuit breaker may be provided with a release lever connected to the manual operating handle provided on a cover of the breaker housing for releasing the engagement protrusion of the trip indicating member from the trip indicating window through a reset operation by the manual operating handle.

An engagement protrusion as the trip indicating member for indicating the tripping state may be provided at a side edge of the trip member. The trip indicating window corresponding to the engagement protrusion is formed in a side wall of the breaker housing.

With the above arrangement, the engagement protrusion provided at the leading end of the trip indicating member for identifying the tripping state normally stays at a position away from the trip indicating window formed in the housing. When the circuit breaker trips instantaneously in response to a flow of the short circuit current, the trip member slides to a trip position in response to an operation of the instantaneous tripping device. Along with the sliding movement of the trip member, the engagement projection of the trip indicating member moves from the retracted position to the indicating position, so that the engagement projection is inserted into the trip indicating window and locked within a frame thereof at the same time. In this state, whether the circuit breaker trips instantaneously can be visually confirmed through the trip indicating window from the outside. As the trip member is locked at the trip position, the circuit breaker can not be turned on again.

After confirming that a circuit or equipment connected to the circuit breaker is recovered, the engagement protrusion of the trip indicating member is released from the trip indicating window to return the trip member to the original position, and the operating handle is turned to a reset position to allow the circuit breaker to turn on again. In this case, in order to release the engagement protrusion of the trip indicating member from the trip indicating window, the engagement protrusion is pushed from the trip indicating window by such a tool as a driver, or the release lever provided in the operating handle is turned to the reset position for releasing the engagement protrusion of the trip indicating member from the trip indicating window.

DETAILED DESCRIPTION PREFERRED EMBODIMENTS

Figure 1A:
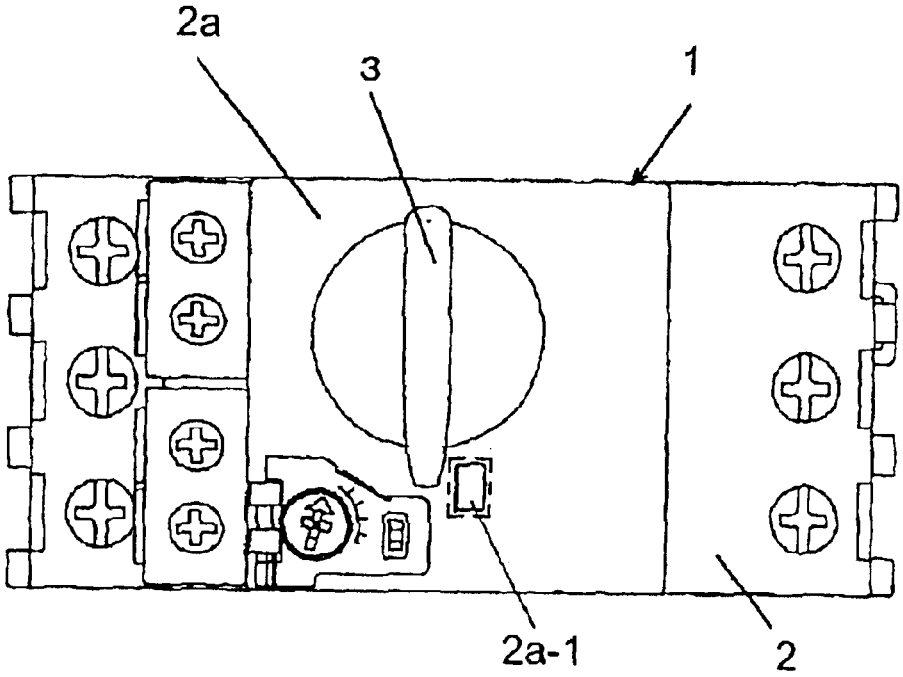
FIGS. 1(*a*) and 1(*b*) are views showing a construction of a circuit breaker according to the first embodiment of the present invention, wherein FIG. 1(*a*) is a plan view of the circuit breaker, and FIG. 1(*b*) is a side view showing an internal structure of the circuit breaker in a state where the circuit breaker trips instantaneously.
Figure 1B:
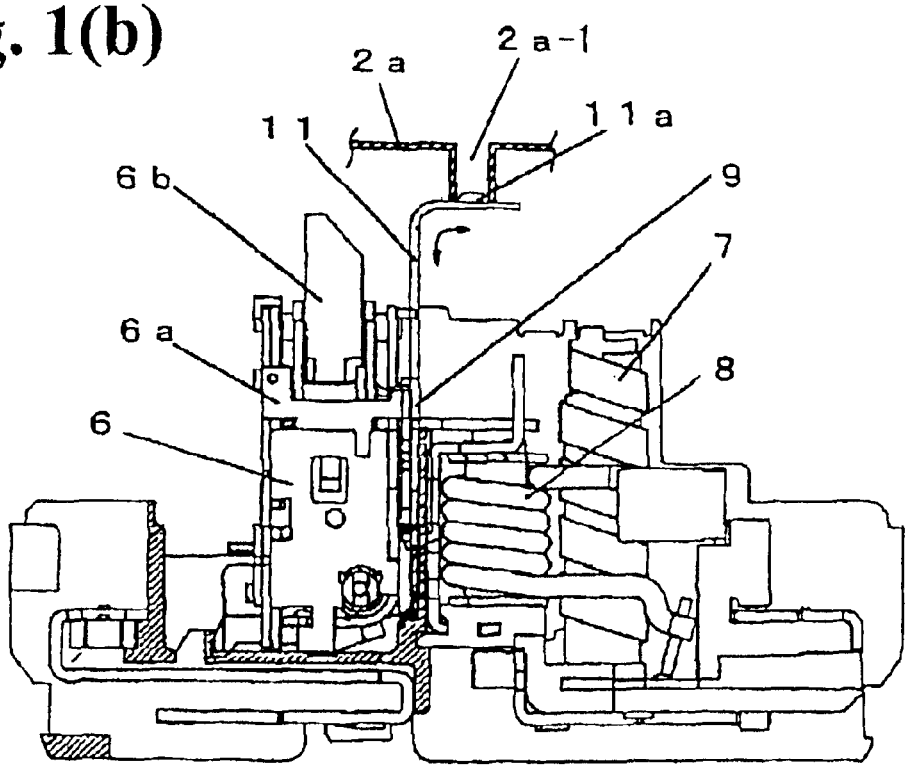
Figure 7:
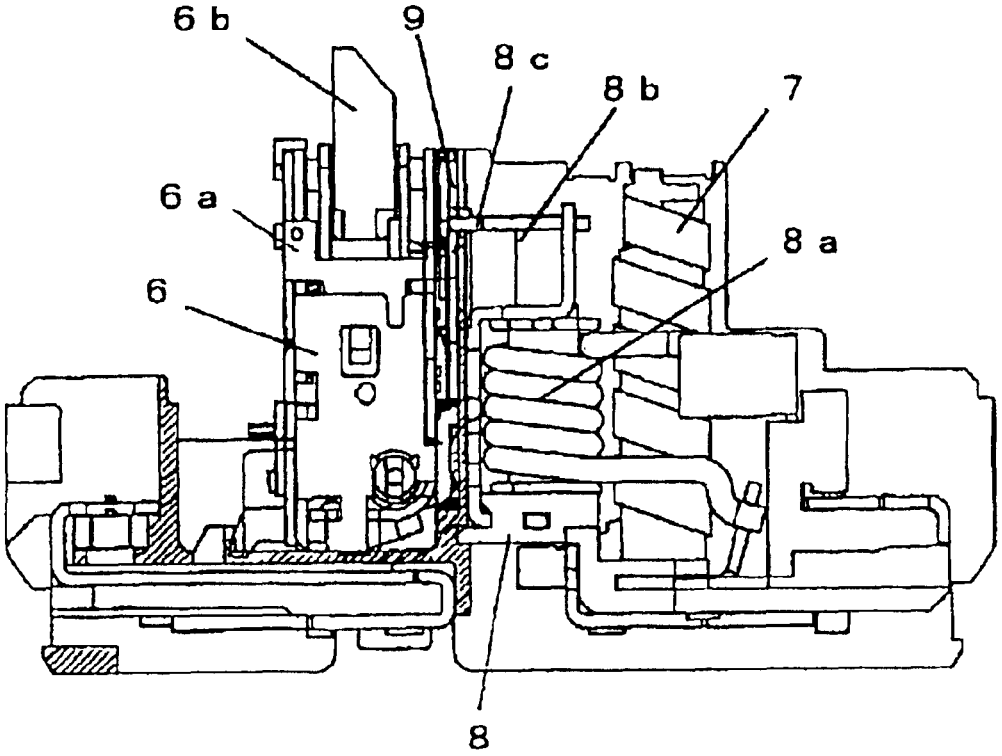
Fig. 7 Prior Art
FIG. 7 is a side view showing an internal structure of the circuit breaker in FIGS. 6(*a*) and 6(*b*)
Figure 8:
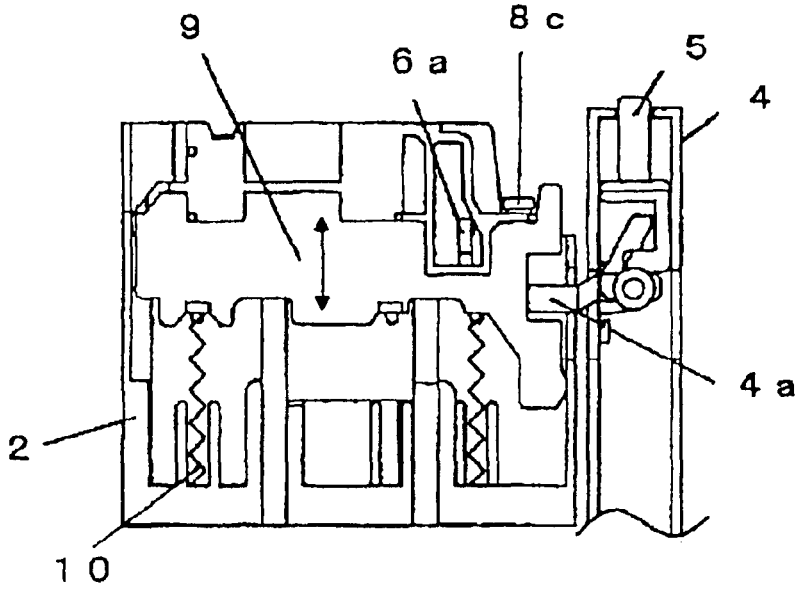
Fig. 8 Prior Art
FIG. 8 is a front view showing a connecting structure between a trip member and the alarm switch in a steady state of the circuit breaker in FIGS. 6(*a*) and 6(*b*).

Hereunder, embodiments of the present invention will be described in detail with reference to FIGS. 1(*a*)-5(*b*). It should be noted that elements and parts corresponding to those in FIGS. 7 and 8 are denoted by the same reference numerals, and a description thereof is omitted.

The first embodiment of the present invention will be explained with reference to FIGS. 1(*a*)-3.

According to the first invention, a circuit breaker 1 has a trip member 9 for connecting a latch receiver 6*a* of a switching mechanism 6 to an instantaneous tripping device 8. The trip member 9 is formed of an elastic band piece extending upward, and has a trip indicating member 11 at an end thereof. The trip indicating member 11 is provided with an engagement protrusion 11*a* for indicating that the circuit breaker 1 trips. A trip indicating window 2*a*-1 corresponding to the engagement protrusion 11*a* of the trip indicating member 11 is formed in a housing cover 2*a* of the circuit breaker 1. The engagement protrusion 11*a* is marked in advance with a color, for example, red, so that it can be seen from the outside through the trip indicating window 2*a*-1.

Figure 3:
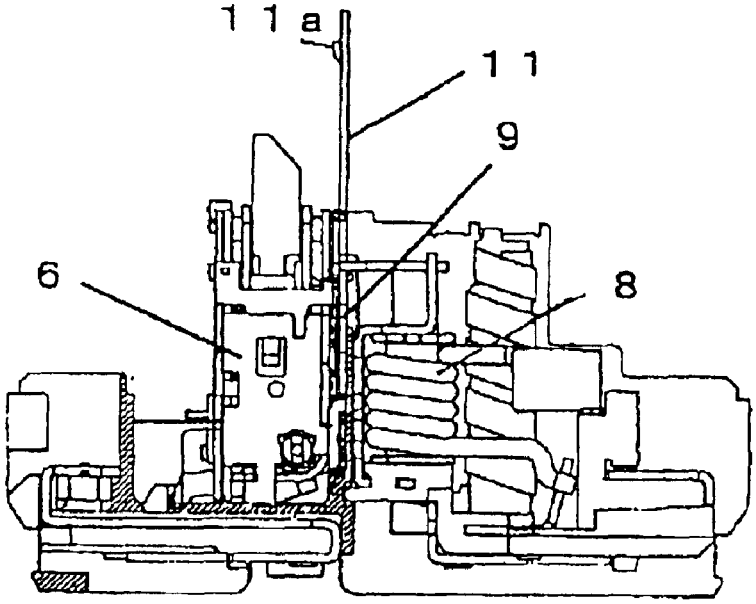
FIG. 3 is a view showing a state where a trip indicating member in FIG. 1(*b*) is free.

The trip indicating member 11 is made of a resin with an elasticity, so that it is restored from a deformed state to an original linear shape as shown in FIG. 3. In the present embodiment, the trip indicating member 11 is integrated with the trip member 9.

Figure 2:
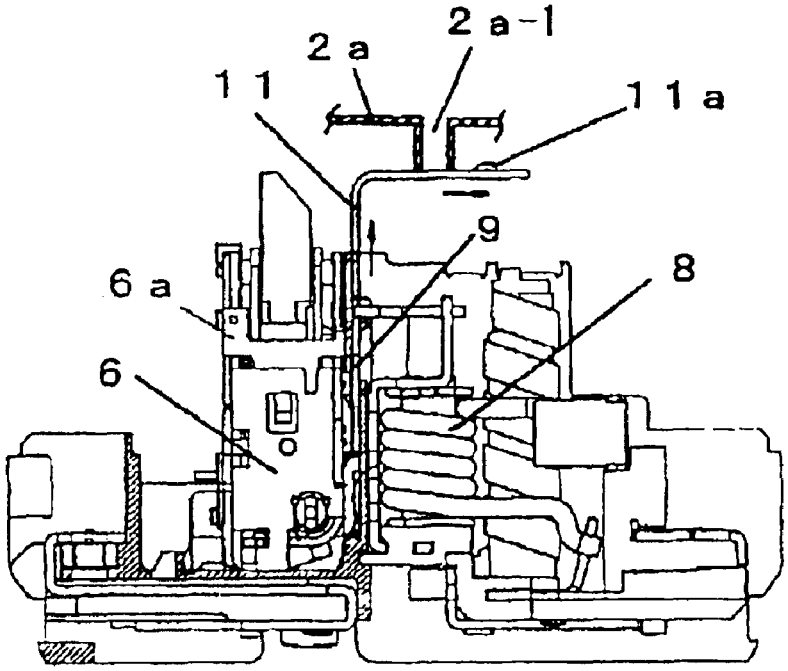
FIG. 2 is a view showing a steady state after the circuit breaker in FIG. 1(*b*) is reset.

In the assembled circuit breaker 1, as shown in FIG. 2, an end of the trip indicating member 11 is bent in an L-shape to abut against a backside of the housing cover 2*a* of the breaker main body housing 2. FIG. 2 shows a steady state (trip-free state) in which the trip member 9 is pressed upward by the return spring 10 (FIG. 8), and in this state, the engagement protrusion 11*a* of the trip member 11 is receded from the trip indicating window 2*a*-1 formed in the housing cover 2*a*.

When the circuit breaker 1 is in an actual use and the instantaneous tripping device 8 is operated in response to a short-circuit current, the trip member 9 is pushed down in response to the operation of the instantaneous tripping device 8. The trip member 9 drives the latch receiver 6*a* of the switching mechanism 6 to the release position as described with reference to FIGS. 7 and 8, so that the circuit breaker 1 trips instantaneously. While the trip member 9 is pushed down with the tripping action, the band piece of the trip indicating member 11 moves to a position indicated in FIG. 1(*b*) where the engagement projection 11*a* fits in the trip indicating window 2*a*-1. Accordingly, the engagement protrusion 11*a* fits in the display window 2*a*-1 to hold the trip member 9 at a lower trip position.

Therefore, in this tripping state, by seeing through the trip indicating window 2*a*-1 from the outside, it is possible to determine whether the circuit breaker 1 trips due to an overload or trips instantaneously due to a short-circuit current. That is, when the engagement protrusion 11*a* of the trip indicating member is not visible through the trip indicating window 2*a*, it indicates that the circuit breaker 1 trips with a delay in response to an overload current. When the engagement protrusion 11*a* fits in the trip indicating window 2*a* to be visible, it indicates that the circuit breaker 1 instantaneously trips in response to the short-circuit current. Furthermore, after the circuit breaker 1 trips instantaneously, it is possible to prevent the circuit breaker 1 from being turned on again by mistake before the circuit or device, to which the circuit breaker is connected, recovers from the short-circuit condition.

Incidentally, to turn on the circuit breaker 1 again after the instantaneous tripping, the trip member 9 is required to return to the original position by releasing the engagement protrusion 11*a* of the trip member 11 from the trip indicating window 2*a*-1. For this purpose, the engagement protrusion 11*a* of the trip indicating member 11 caught in the trip indicating window 2*a*-1 is pushed inward by using a tool such as a driver to return the trip member 9 to the original position by the force of the spring. The operating handle 3 is then turned from the TRIP position to the OFF position to reset the circuit breaker 1. This allows the circuit breaker 1 to be turned on again. In the first embodiment, the trip indicating member 11 is integrated with the trip member 9. Alternatively, the trip indicating member may be attached to the trip member.

The second embodiment of the present invention will be explained with reference to FIGS. 4(*a*) and 4(*b*). In the first embodiment, the engagement protrusion 11*a* of the trip indicating member 11 is released from the trip indicating window 2*a*-1 using a tool such as a driver. According to the second embodiment, the circuit breaker 1 has means for resetting the circuit breaker 1 automatically through the operation of the operating handle 3.

Figure 4A:
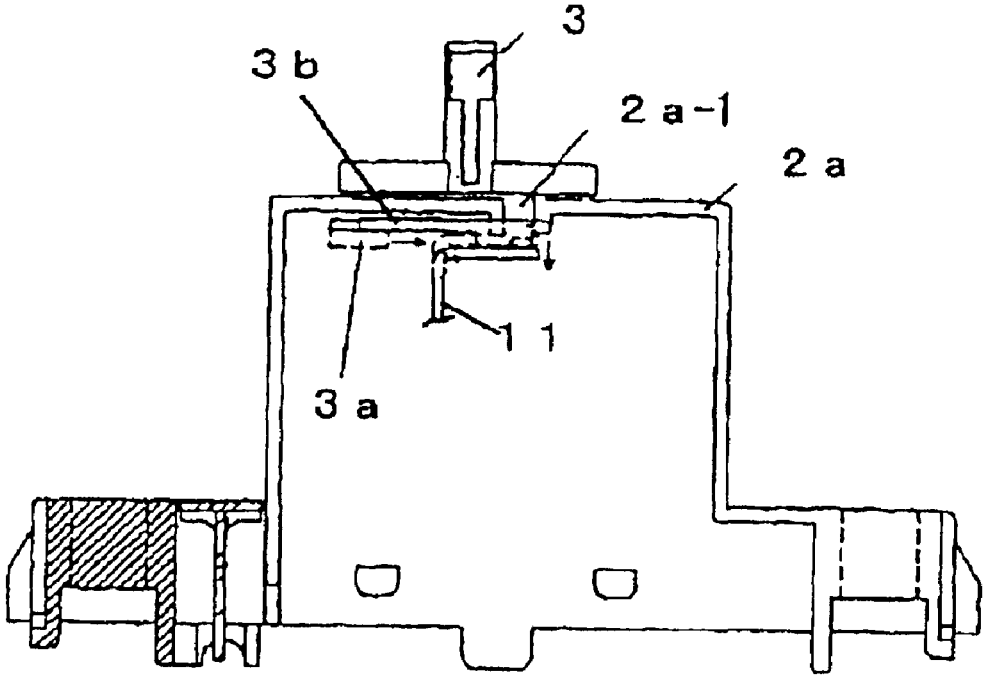
FIGS. 4(*a*) and 4(*b*) are views showing a construction of a circuit breaker according to the second embodiment of the present invention, wherein FIG. 4(*a*) is a longitudinal side view showing a housing cover provided with an operating handle, and FIG. 4(*b*) is a plan view thereof seen from backside.
Figure 4B:
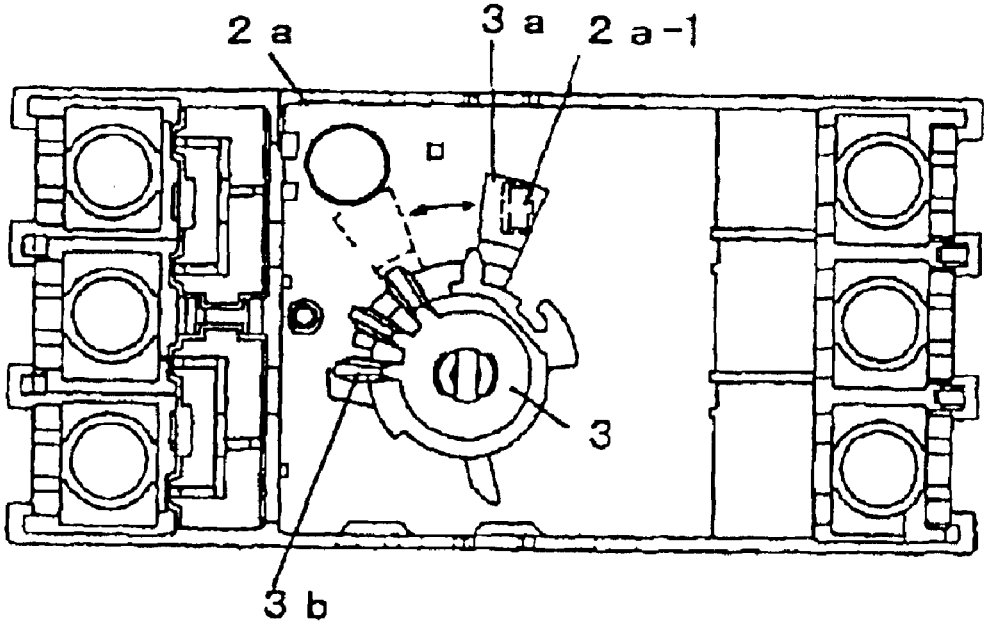

In the second embodiment shown in FIGS. 4(*a*) and 4(*b*), a release lever 3*a* is provided at a backside of the housing cover 2*a* such that the release lever 3*a* is connected to the operating handle 3 for releasing the engagement protrusion 11*a* of the trip indicating member 11 from the trip indicating window 2*a*-1 as described in the first embodiment. A drive gear 3*b* provided in the operating handle 3 is connected to the transmission gear 6*b* of the switching mechanism 6 shown in FIG. 1(*b*).

With the above arrangement, after the circuit or equipment recovers from the short-circuit, the operating handle 3 at the TRIP position is turned to the OFF position for resetting the circuit breaker 1. Accordingly, the release lever 3*a* turns from a position indicated by a hidden line to a position indicated by a solid line in FIG. 4(*b*) to be inserted in a space between the trip indicating window 2*a* and the engagement protrusion 11*a* of the trip indicating member 11 to release the engagement protrusion 11*a* from the trip indicating window 2*a*. The trip member 9 and the trip indicating member 11 return to the state shown in FIG. 2. Thus, the circuit breaker 1 turns on again through turning the operating handle 3 from the OFF position to the ON position.

Figure 5A:
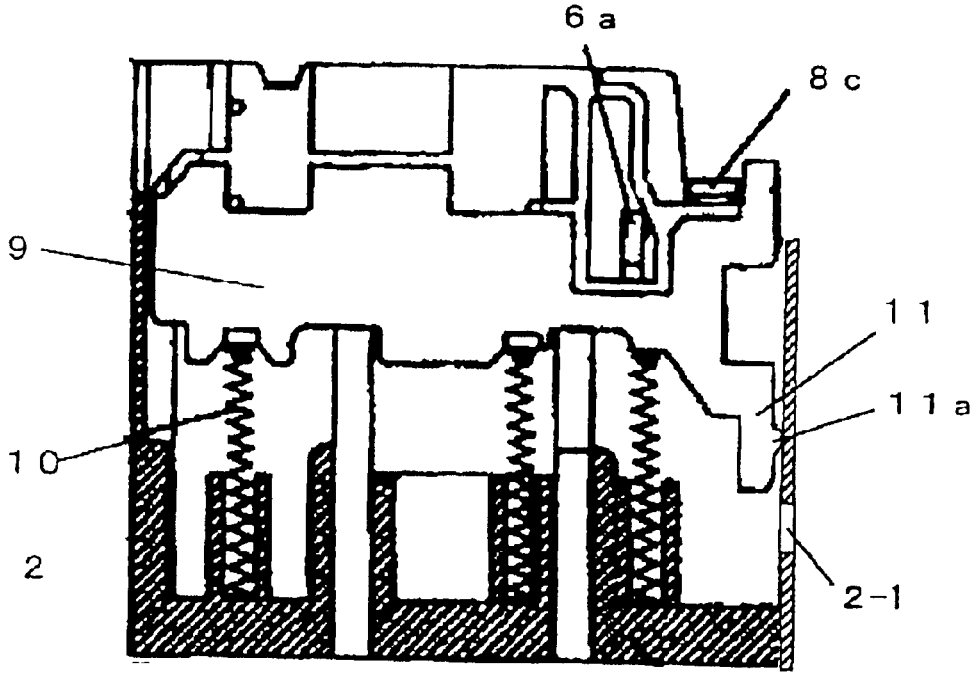
FIGS. 5(*a*) and 5(*b*) are views showing a construction of an essential part of a circuit breaker according to the third embodiment of the present invention, wherein FIG. 5(*a*) is a front view showing a trip member and a peripheral part in a steady state of the circuit breaker, and FIG. 5(*b*) is a front view showing the trip member and the peripheral part in a state where the circuit breaker trips instantaneously.
Figure 5B:
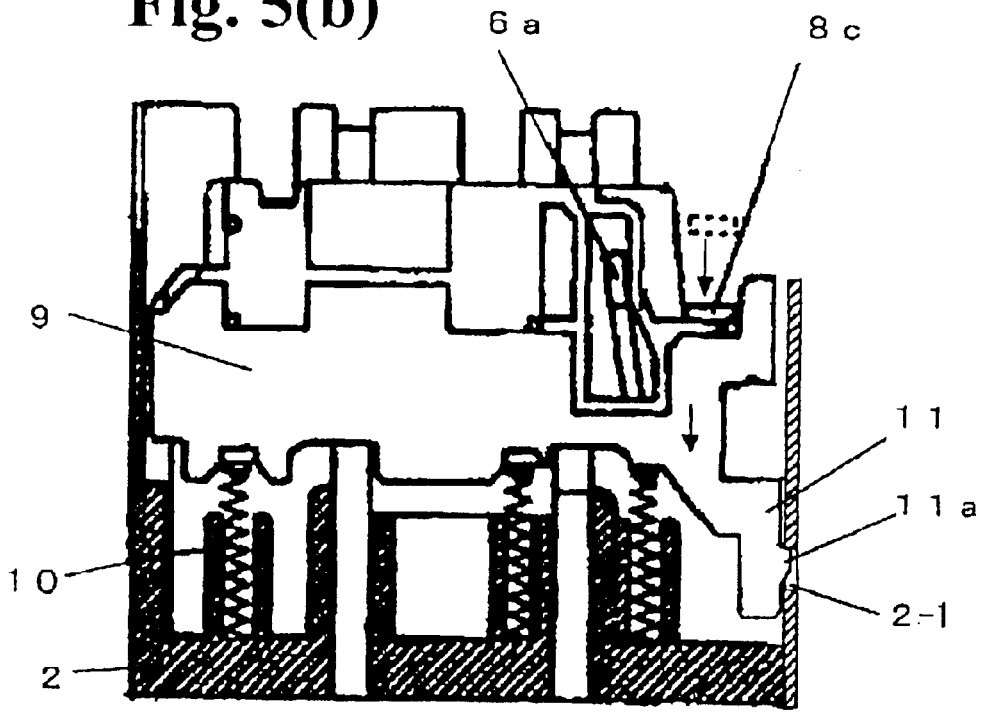
Figure 6A:
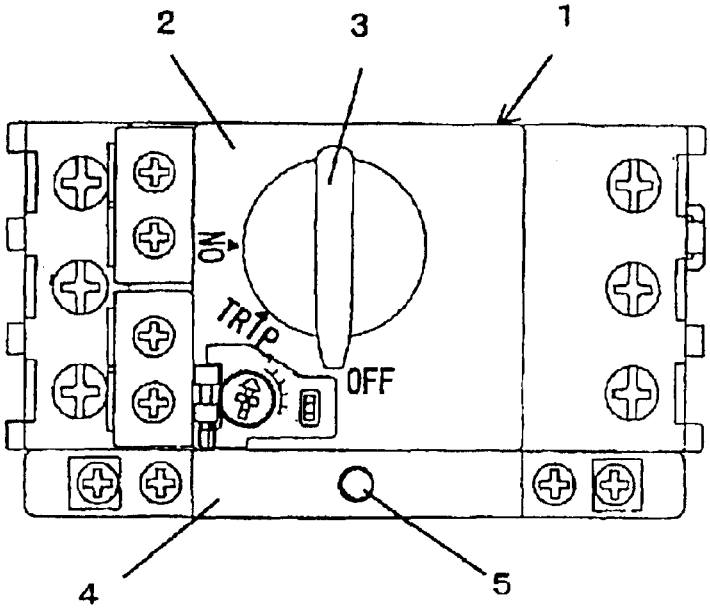
Fig. 6(a) Prior Art
FIGS. 6(*a*) and 6(*b*) are views showing an appearance of a conventional circuit breaker to which an alarm switch is attached, wherein FIG. 6(*a*) is a plan view and FIG. 6(*b*) is a side view.
Figure 6B:
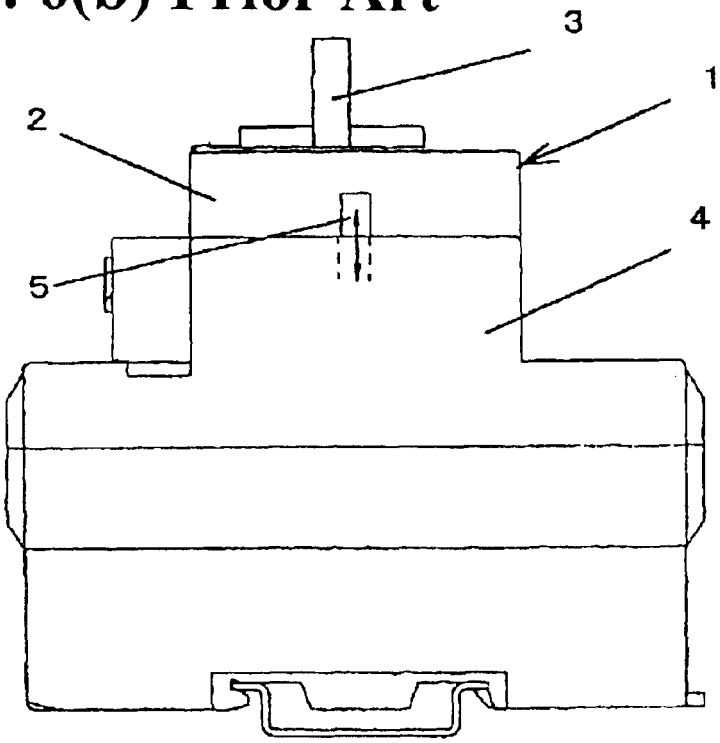
Fig. 6(b) Prior Art

The third embodiment of the present invention will be explained with reference to FIGS. 5(*a*) and 5(*b*). In the third embodiment, the trip indicating member 11 is integrated with a side edge of the trip member 9. A trip indicating window 2-1 is formed in a sidewall of the breaker main body housing 2 to face the engagement protrusion 11*a* formed in the trip indicating member 11 for indicating that the circuit breaker 1 trips. FIG. 5(*a*) shows a steady state in which the trip member 9 is pressed upward by the return spring 10, and FIG. 5(*b*) shows an instantaneous tripping state in which the instantaneous tripping device operates to cause the trip actuator 8*c* thereof to push down the trip member 9 to drive the latch receiver 6*a* of the switching mechanism to the release position. The trip indicating window 2-1 is arranged so that the engagement protrusion 11*a* of the trip indicating member 11 fits in the window hole in the state shown in FIG. 5(*b*).

With the above arrangement, when the circuit breaker trips instantaneously, it can be determined that the circuit breaker instantaneously trips due to the short-circuit current by seeing the engagement protrusion 11*a* of the trip indicating member 11 through the trip indicating window 2-1 as in the first embodiment. Incidentally, to turn on the circuit breaker 1 again after the instantaneous tripping, the engagement protrusion 11*a* is released from the trip indicating window 2-1 by means of a tool such as a driver to return the trip member 9 to the original position by the force of the spring. Accordingly, the circuit breaker 1 turns on again by operating the operating handle 3.

As described above, the present invention provides the circuit breaker having the switching mechanism for switching contacts, the manual operating handle connected to the switching mechanism, and the instantaneous tripping device for opening the contacts of the main circuit upon detection of the short-circuit current. The instantaneous tripping device and the latch receiver of the switching mechanism are connected with each other via the trip member capable of sliding up and down. The trip member slides in response to the movement of the instantaneous tripping device, and drives the latch receiver to the release position to trip the switching mechanism. Further, the circuit breaker includes the trip indicating member moving in response to the movement of the trip member, and the trip indicating window formed in the breaker housing to face the trip indicating member. The trip indicating member moves to the indicating position in response to the instantaneous tripping of the circuit breaker so that the tripping state of the circuit breaker can be visually confirmed through the trip indicating window.

Therefore, when the circuit breaker trips, it is possible to confirm visually whether the circuit breaker trips due to the overload current or instantaneously trips due to the short-circuit current without using an alarm switch as an attachment to the circuit breaker.

Further, the existing trip member is used as the trip indicating means. Therefore, only a small number of parts is added. Moreover, the engagement protrusion of the trip indicating member fits in the trip indicating window when the circuit breaker trips, so that the trip member is locked at the trip position. Thus, it is possible to prevent the circuit breaker from being turned on by mistake, thus improving the safety.

While the invention has been explained with reference to the specific embodiments of the invention, the explanation is illustrative and the invention is limited only by the appended claims.

What is claimed is:

1. A circuit breaker comprising:

a casing having an indicating window, a switching mechanism disposed in the casing for opening and closing contacts, a manual operating handle connected to the switching mechanism for operating the same, an instantaneous tripping device for actuating the switching mechanism to open the contacts upon detection of a short-circuit current, a trip member situated between the switching mechanism and the instantaneous tripping device, said trip member being slidable upon actuation of the instantaneous tripping device, and a trip indicating member attached to the trip member to face the indicating window formed in the casing and moving to be visible through the trip indicting window when the instantaneous tripping device actuates the switching mechanism upon detection of the short-circuit current, said trip indicating member being formed in a band shape having one end attached to the trip member and including an engagement protrusion adjacent to the other end thereof, said other end being arranged at a rear side of the trip indicating window so that the engagement protrusion fits in the trip indicating window at a time of tripping to be seen through the trip indicating window.

2. A circuit breaker according to claim 1, further comprising a release lever connected to the manual operating handle for releasing the engagement protrusion of the trip indicating member from the trip indicating window upon reset operation of the manual operating handle.

3. A circuit comprising:

a casing having an indicating window, a switching mechanism disposed in the casing for opening and closing contacts, a manual operating handle connected to the switching mechanism for operating the same, an instantaneous tripping device for actuating the switching mechanism to open the contacts upon detection of a short-circuit current, a trip member situated between the switching mechanism and the instantaneous tripping device, said trip member being slidable upon actuation of the instantaneous tripping device, and a trip indicating member attached to the trip member to face the indicating window formed in the casing, said trip indicating member moving to be visible through the trip indicting window when the instantaneous tripping device actuates the switching mechanism upon detection of the short-circuit current, wherein said trip member includes an engagement protrusion at a side portion thereof as the trip indicating member, and said trip indicating window is formed in a sidewall of the casing corresponding to the engagement protrusion.

4. A circuit breaker according to claim 1, wherein said switching mechanism includes a latch receiver, said trip member being slidable between the latch receiver and the instantaneous tripping device.

* * * * *

UNITED STATES PATENT AND TRADEMARK OFFICE

CERTIFICATE OF CORRECTION

PATENT NO. : 6,819,206 B2
DATED : November 16, 2004
INVENTOR(S) : Takeshi Emura et al.

It is certified that error appears in the above-identified patent and that said Letters Patent is hereby corrected as shown below:

Column 2,
Line 56, remove comma after "that"

Column 8,
Line 10, after "circuit" insert -- breaker --

Signed and Sealed this

Fifteenth Day of February, 2005

JON W. DUDAS
*Director of the United States Patent and Trademark Office*